US010699893B1

(12) United States Patent
Roman et al.

(10) Patent No.: US 10,699,893 B1
(45) Date of Patent: Jun. 30, 2020

(54) ION TRAP WITH NOTCHED RING ELECTRODE

(71) Applicants: Patrick Roman, Coral Gables, FL (US); Shekhar Bhansali, Weston, FL (US)

(72) Inventors: Patrick Roman, Coral Gables, FL (US); Shekhar Bhansali, Weston, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 16/722,971

(22) Filed: Dec. 20, 2019

(51) Int. Cl.
*H01J 49/42* (2006.01)
*H01J 49/00* (2006.01)

(52) U.S. Cl.
CPC ..... *H01J 49/424* (2013.01); *H01J 49/0031* (2013.01)

(58) Field of Classification Search
CPC .... H01J 49/0027; H01J 49/0031; H01J 49/42; H01J 49/4205; H01J 49/424; H01J 49/4245; H01J 49/425; H01J 49/4255
See application file for complete search history.

(56) References Cited

U.S. PATENT DOCUMENTS 9,805,923 B2 * 10/2017 Goodwin ..... H01J 49/0031
2009/0321624 A1 * 12/2009 Fang ..... H01J 49/422 250/281
2014/0252219 A1 * 9/2014 Rafferty ..... H01J 49/0031 250/282

FOREIGN PATENT DOCUMENTS

CA 2446964 A1 * 11/2002 ..... H01J 49/4255

OTHER PUBLICATIONS

Chaudhary et al, "Fabrication and Testing of Miniature Cylindrical Ion Trap Mass Spectrometer Constructed from Low-Temperature Co-Fired Ceramics", International Journal of Mass Spectrometry 251 (2006) 32-39 (Year: 2006).*
Tallapragada et al, "Geometry Optimization of Axially Symmetric Ion Traps", International Journal of Mass Spectrometry 264 (2007) 38-52 (Year: 2007).*

* cited by examiner

*Primary Examiner* — David E Smith
(74) *Attorney, Agent, or Firm* — Saliwanchik, Lloyd & Eisenschenk

(57) ABSTRACT

Cylindrical ion traps (CITs) that can be used for molecular sample identification, as well as systems and methods using the same, are provided. A CIT can utilize a notched ring electrode having an inner diameter that increases as a first end of the CIT is approached from the center of the CIT or from a second end of the CIT. The first end can be the one positioned closer to the ion detector than is the second end, which can be positioned closer to the ion source than is the first end.

18 Claims, 12 Drawing Sheets

Notched CIT

CIT

Notched CIT

Notched LTCC CIT

Notched CIT

ION TRAP WITH NOTCHED RING ELECTRODE

BACKGROUND

Ion traps are quadrupole mass analyzers used to trap, store, and sort charged particle ions by their mass, and serve as the basis of ion trap mass spectrometer instruments. In general, quadrupole ion traps (QIT) or Paul ion traps are devices comprised of three electrodes creating an electric field equipotential well at their central axis for trapping, storing, and sorting ions. This is accomplished through applied radio frequency (RF) and direct current (DC) voltages to the central ring and end cap electrodes of the trap, respectively.

Ion traps are a type of mass spectrometer used for molecular sample identification. Cylindrical ion traps (CIT) are a simplified version with two end plates and one central ring electrode with flat plate geometry. Ion traps and CITs operate by containing or "trapping" charged particles in a symmetric oscillating electric field for subsequent analysis by increasing the magnitude of the oscillating field. Analysis of the sample ions (analyte) is done by axial ejection of the ions, where the ion signal is recorded by a detector. However, the axial ion ejection occurs in equal and opposite directions along the ejection axis, so about half of the sample analyte is typically lost in analysis. That is, existing QITs and CITs are symmetric devices where half (or approximately half) of the mass sorted ions are lost (see, for example, March et al., Quadrupole storage mass spectrometry, Chemical analysis, 1989, New York: Wiley, page 471). As described by March et al, the general equation describing the electric field potential well of the ion trap and ion motion within is, $$\phi = \frac{1}{2}(U - V\cos\Omega t)\left[\frac{x^2 + y^2 - 2\,z^2}{r_o^2}\right] + \left[\frac{U - V\cos\Omega t}{2}\right] \quad (1)$$

with U representing the DC voltage, and V the RF voltage, applied to the end and central ring electrodes respectively (March et al., Practical aspects of ion trap mass spectrometry, Modern mass spectrometry, 1995, Boca Raton, Fla.: CRC Press). The functional radius of the central ring electrode is $r_o$, and $\Omega$ is the frequency of the applied RF voltage.

BRIEF SUMMARY

Embodiments of the subject invention provide novel and advantageous cylindrical ion traps (CITs) that can be used for molecular sample identification, as well as systems using the same, methods of using the same, and methods of fabricating the same. A CIT can utilize a notched ring electrode having a radius or inner diameter that increases as a first end of the CIT is approached from the center of the CIT or from a second (i.e., the other) end of the CIT. The first end can be the one positioned closer to the ion detector than is the second end, which can be positioned closer to the ion source than is the first end. That is, the radius (inner diameter) of the notched ring electrode can increase as the ion detector end or side is approached and can be reduced as the ion source end or side is approached (see, e.g., FIGS. 8B and 10A).

In an embodiment, a CIT can comprise: a first end electrode at a first axial end of the CIT; a second end electrode at a second axial end of the CIT opposite to the first axial end; and a ring electrode disposed axially between the first end electrode and the second electrode and having an annular shape with an inner opening having an inner diameter. The inner diameter of the ring electrode can increase as the first end electrode is approached from an axial center of the CIT, such that the inner diameter of the ring electrode at the axial center is smaller than the inner diameter of the ring electrode at a position thereof closest to the first end electrode. The first end electrode can comprise a first opening, the second end electrode can comprise a second opening, and a center axis of the CIT can pass through the first opening, the second opening, and the inner opening of the ring electrode. The inner diameter of the ring electrode can increase as the axial center is approached from the second electrode. The inner diameter can increase in a stepped manner (preferable) or a continuous manner as the first end electrode is approached. The CIT can further comprise a body comprising a ceramic material, which can be a low temperature co-fired ceramic (LTCC) material. The inner diameter can increase as the first end electrode is approached in such a way that the CIT is configured to direct a significant majority (e.g., at least 60%, at least 65%, at least 70%, at least 75%, at least 80%, at least 85%, at least 90%, at least 95%, at least 99%) of ions (that are ejected) towards the first axial end when a voltage is applied to the CIT. A system for molecular sample identification can comprise: a CIT as disclosed herein; an ion source disposed outside the CIT and positioned facing the second end of the CIT; and an ion detector disposed outside the CIT and positioned facing the first end of the CIT. An inner diameter of the ring electrode can be on the millimeter scale (e.g., around 1 mm or less).

In another embodiment, a method for molecular sample identification can comprise: providing a sample to a CIT as disclosed herein; applying a voltage to the CIT such that ions of the sample are axially ejected from the CIT; and detecting at least a portion of the ejected ions of the sample to generate a mass spectrum to identify the sample. The ions of the sample can be axially ejected from the CIT such that a significant majority (e.g., at least 60%, at least 65%, at least 70%, at least 75%, at least 80%, at least 85%, at least 90%, at least 95%, at least 99%) of the ions being ejected are ejected through the first opening of the first end electrode.

DETAILED DESCRIPTION

Embodiments of the subject invention provide novel and advantageous cylindrical ion traps (CITs) that can be used for molecular sample identification, as well as systems and methods using the same. A CIT can utilize a notched ring electrode having a radius that increases as a first end of the CIT is approached from the center of the CIT or from a second (i.e., the other) end of the CIT. The first end can be the one positioned closer to the ion detector than is the second end, which can be positioned closer to the ion source than is the first end. That is, the radius of the notched ring electrode can increase as the ion detector end or side is approached and can be reduced as the ion source end or side is approached (see, e.g., FIGS. 8B and 10A).

Notched ring electrode CITs of embodiments of the subject invention increase the number of ions ejected towards the detector by creating an asymmetric oscillating field in the axial ion ejection path. This is accomplished by increasing the ring electrode aperture (or radius) in a stepped manner toward the detector relative to the opposite side (i.e., relative to the end or side closer to the ion source). It is noted that in certain embodiments the ring electrode radius can be increased in a smooth manner (as opposed to a stepped manner). The notched ring electrode CIT technology can be used to increase the ion sensitivity of ion trap devices.

Notched ring electrode CITs of embodiments of the subject invention improve the analysis-to-detection ratio for ion traps, as well as the ion signal sensitivity of ion traps. More mass separated ions are sent to the detector compared to related art QITs and CITs, versus being lost in other ejection paths, such that sample ion detection can be doubled or nearly doubled compared to related art devices. Doubling or nearly doubling the ion detection compared to existing ion traps facilitates more complete sample analysis, improved signal statistics with reduced risk of lost signal data, and faster analysis while consuming less power.

Figure 1:
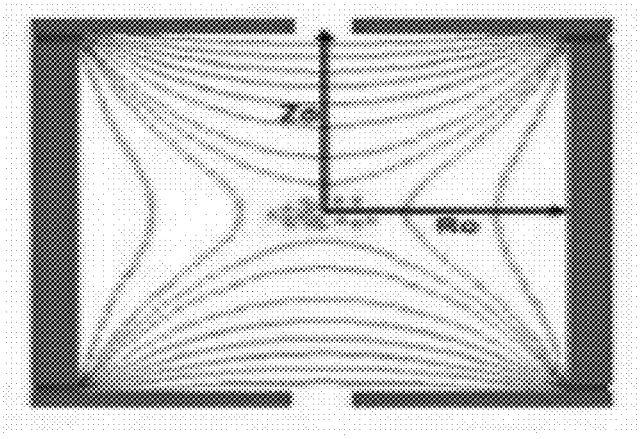
FIG. 1 is a cross-sectional view of a standard cylindrical ion trap (CIT), showing the CIT geometry and electrostatic field lines with a geometric axis.

FIG. 1 is a cross-sectional view of a related art CIT without a varied radius, showing the CIT geometry and electrostatic field lines with a geometric axis. The relationship between the end electrode spacing and the central ring electrode radius is idealized when $$r_o^2=2z_o^2 \tag{2}$$

Ions are trapped and oscillate along the central axis of the ion trap between the two endplate electrodes with the RF field. From the Laplace equation of electrostatics, the forces applied to ions of a given mass and charge is, $$F=-e\cdot\nabla\emptyset=\mathrm{mA} \tag{3}$$

This applied to equation (1) results in expressions for the ion trapping forces for each axis within the equipotential well, as shown below in equations (4), (5), and (6).

$$\left(\frac{m}{e}\right)x+(U-V\cos\Omega t)\frac{x}{r_o^2}=0 \tag{4}$$

$$\left(\frac{m}{e}\right)y+(U-V\cos\Omega t)\frac{y}{r_o^2}=0 \tag{5}$$

$$\left(\frac{m}{e}\right)z-2(U-V\cos\Omega t)\frac{z}{r_o^2}=0 \tag{6}$$

As quadrupole ion traps are symmetric, x and y components may be combined to form a radial component, $x^2+y^2=r^2$.The z component is negative as the ion motion is 180° out of phase with the r component ion motion. Each of these expressions is a form of the Mathieu equation, $$\frac{d^2u}{d\varepsilon^2}+(a_u+2q_u\cos 2\varepsilon)u=0 \tag{7}$$

and for the ion trap, $$u=x,\ y,\ z \tag{8}$$

$$\varepsilon=\frac{\Omega t}{2} \tag{9}$$

with the axial component being, $$a_z=-2\,a_x=-2\,a_x=-\frac{16\,eU}{m(r_0^2+2\,z_0^2)\Omega^2} \tag{10}$$

and the radial component, $$q_z=-2\,q_x=-2\,q_y=\frac{8\,\mathrm{eV}}{m(r_0^2+2\,z_0^2)\Omega^2} \tag{11}$$

Equations (10) and (11) are the experimental equations of motion for trapped ions within the ion trap. Both $a_z$ and $q_z$ are the Mathieu parameters for the ion trap and represent ion motion stability or instability within the trap. Values for $a_z$ and $q_z$ must remain within in the stable boundary region for ions to remain trapped. An ion trap operated in this mode, QIT mode, may trap ions for extended periods of time for ion separation, containment, and or reaction purposes. The QIT may be operated at a mass spectrometer (QITMS) in mass-selective ejection mode. In this mode, direct current (DC) voltages on the trap endplates are held to zero volts, so ion motion in $a_z$ is minimal or nonexistent. However, the ion motion in $q_z$ may be varied from 0 to 0.908, minimum to maximum instability, via increasing the force on the ions by ramping up the radio frequency (RF) voltage on the central ring electrode. Operating the QITMS in this mode initially traps ions of a predetermined mass range and then scans them out lowest to highest mass as their motion becomes unstable with increasing voltage, thus creating a mass spectrum.

Figure 2:
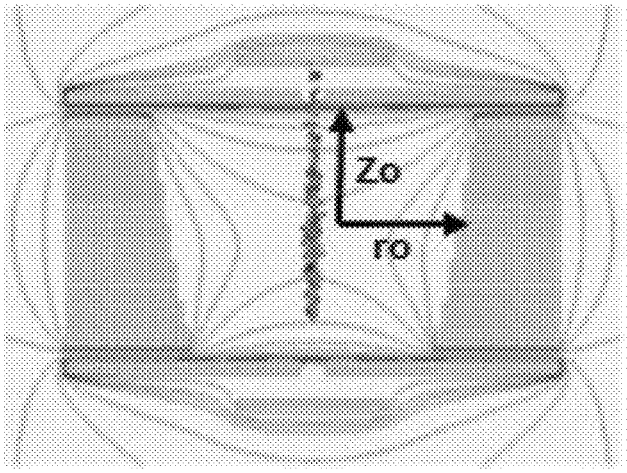
FIG. 2 is a cross-sectional view of a notched CIT according to an embodiment of the subject invention, showing the CIT geometry and electrostatic field lines.
Figure 5:
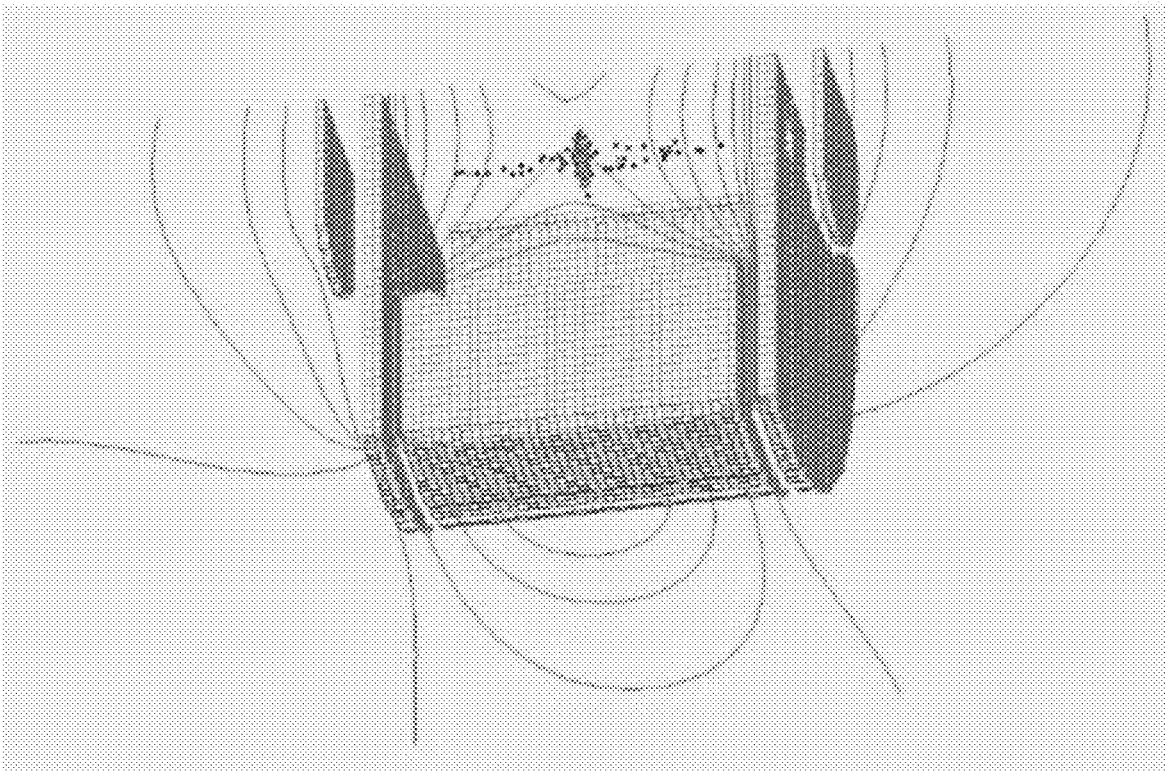
FIG. 5 is a perspective view of a CIT according to an embodiment of the subject invention, showing electrostatic field lines.

FIG. 2 is a cross-sectional view of a CIT according to an embodiment of the subject invention, showing the CIT geometry and electrostatic field lines. FIG. 5 is a perspective view of a notched CIT according to an embodiment of the subject invention, showing electrostatic field lines. Referring to FIG. 2, the radius ($r_o$) of the central ring electrode can be varied such that it is greater at one end of the CIT than it is at the other end. The end with the greater radius can be positioned closer to the ion detector than the other end is, and the other end can be positioned closer to the ion source than the end with the greater radius is (see also, e.g., FIGS. 8B and 10A). This configuration greatly increases the ion detection efficiency of a CIT, which can be utilized in a ceramic system (e.g., a metallized ceramic material system).

Conventional ion traps have a symmetric design and are operated to form an equipotential well at the center of the trap geometry, such a structure supports a balanced electrostatic field environment for ion trapping and scanning to produce mass spectra. However, given the symmetric equipotential well and the oscillations of the ions within, ions are ejected from both sides of the trap as the mass ejection forces or RF voltage is increased. Most QIT and CIT instruments employ internal or external ionization at one side of the trap and have one ion detector on the opposing side of the trap. The conventional instrumentation results in the loss of half or more of the mass sorted ions at the detector, and lost peaks due to the ions being ejected from both sides of the trap from the equipotential well and the use of one detector. This ion signal loss is sometimes remedied by increasing the instrument duty cycle, resulting in data summation for mass spectrum generation. While producing useable mass spectra, this method requires twice (or approximately twice) the amount of analysis, analyte, and instrument power consumption. This is a significant problem for miniaturized portable instruments with restricted sampling and power resources.

Embodiments of the subject invention make use of a quasi-equipotential well produced by reducing the trapping forces on the ring electrode nearest the detector, as shown in equation 6. This approach results in nearly all of the mass sorted ions being directed to the detector, greatly reducing ion signal loss, as well as instrument analyte and power consumption. Mass spectra data are also more consistent, increasing analysis confidence. An increased radius can be utilized to reduce trapping forces, directing ions towards the detector for increased ion detection efficiency.

Figure 4:
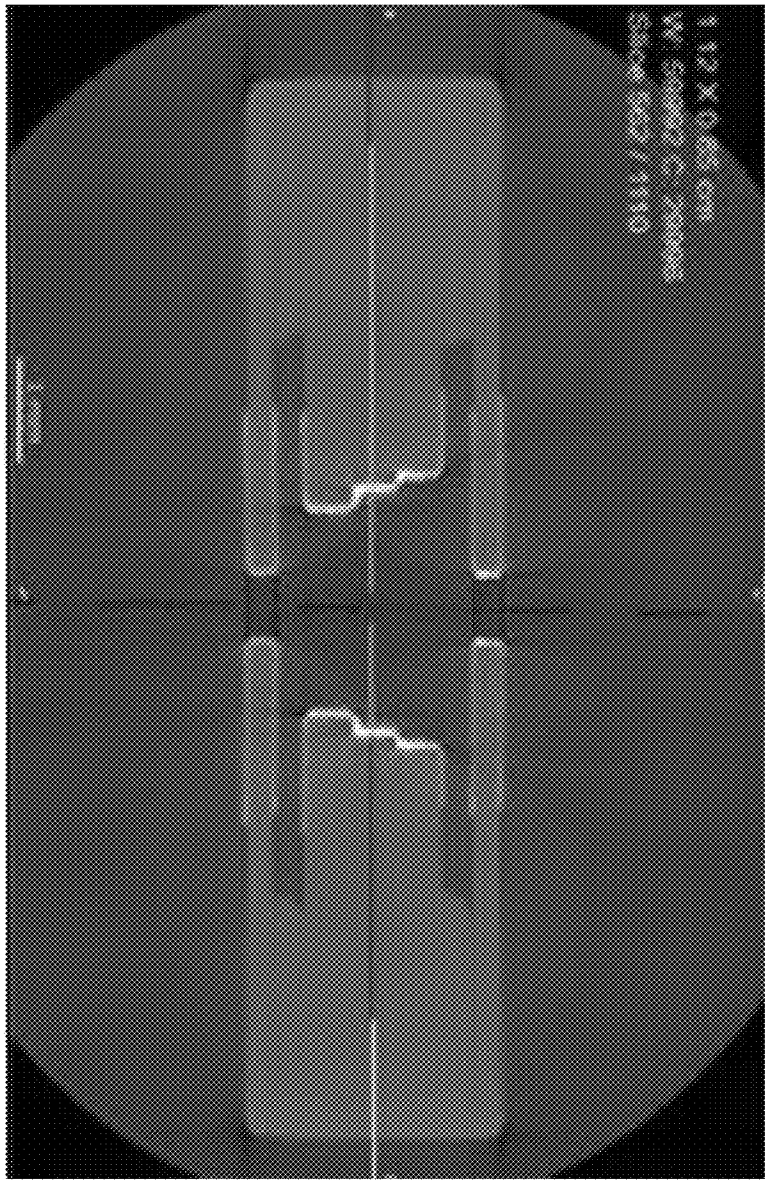
FIG. 4 is an internal X-ray image of a notched CIT according to an embodiment of the subject invention, showing a cross-sectional view of the notched electrode structure.

FIG. 4 is an internal X-ray image of a notched CIT according to an embodiment of the subject invention, showing a cross-sectional view of the notched electrode structure. Referring to FIG. 4, the CIT can include a central notched ring electrode and two identical end plate electrodes (at top and bottom of the figure). All electrodes are can be concentrically positioned about a central axis, with both end plate electrodes equidistant from a horizontal axis within the ring electrode. An ion detector would be placed above the CIT as depicted in FIG. 4, and an ion source would be placed below the CIT as depicted in FIG. 4.

A low temperature co-fired ceramic (LTCC) material system can be used to construct a notched CIT. The ceramic material can provide structural and electrically insulating properties and surfaces on which the metallized electrodes can be disposed. RF, DC, and/or alternating current (AC) voltages can be applied to the ring and end plate electrodes in various forms to create the quasi-equipotential well for ion trapping and ejection. The increasing radius of the notched ring electrode reduces the electrostatic trapping forces applied to the oscillating ions allowing them to constantly migrate to one end (the end with the larger central electrode radius, i.e., the top end as depicted in FIG. 4) of the ion trap with standard RF voltage ramping. Ions are ejected from the largest $r_o$ side of the ion trap, thus determining the optimal location for ion detector placement.

Embodiments of the subject invention provide a significant improvement for CIT miniaturization, mesoscale and smaller. As CITs reduce in size the amount of analyte also reduces. The notched ring electrode CIT technology improves the analysis-to-detection ratio and ion signal sensitivity for ion traps. More mass separated ions are sent to the detector compared to related art devices, versus being lost in other ejection paths, and this doubles or nearly doubles sample ion detection. Doubling or nearly doubling the ion detection over existing ion traps facilitates more complete sample analysis, improved signal statistics with reduced risk of lost signal data, faster analysis, and less power consumption.

Embodiments of the subject invention provide increased ion signal sensitivity. This enables miniature and power-limited portable or remote deployable ion traps with efficient operation. Miniature chip-based mass spectrometry technology is an emerging field with growing applications, and embodiments of the subject invention advance this field.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to the invention.

EXAMPLE 1

Figure 3:
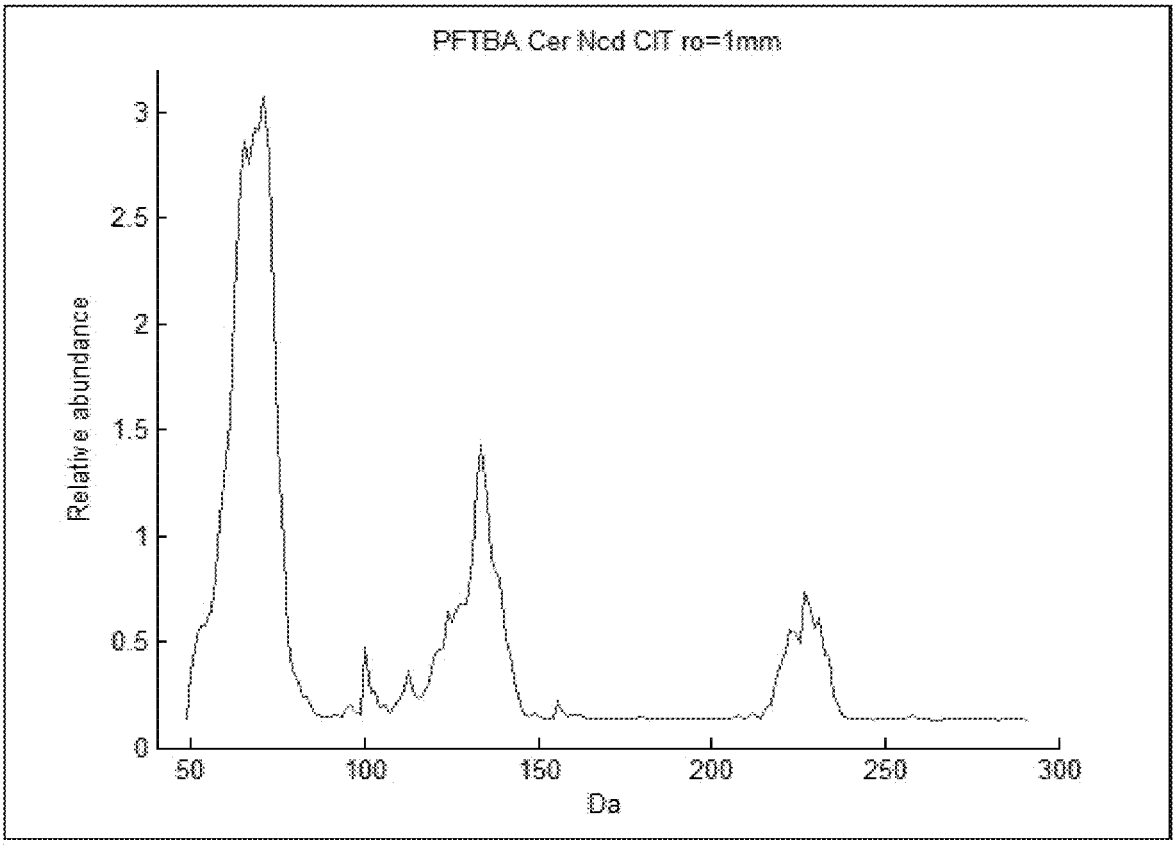
FIG. 3 is a mass spectrum of perfluorotributylamine (PFTBA) generated using a notched CIT according to an embodiment of the subject invention, using an $r_o$ (functional radius of the central ring electrode) of 1 millimeter (mm).

A notched CIT was constructed using a metalized ceramic material system and was tested to generate mass spectra of perfluorotributylamine (PFTBA). FIG. 3 shows the mass spectrum results.

Figure 6:
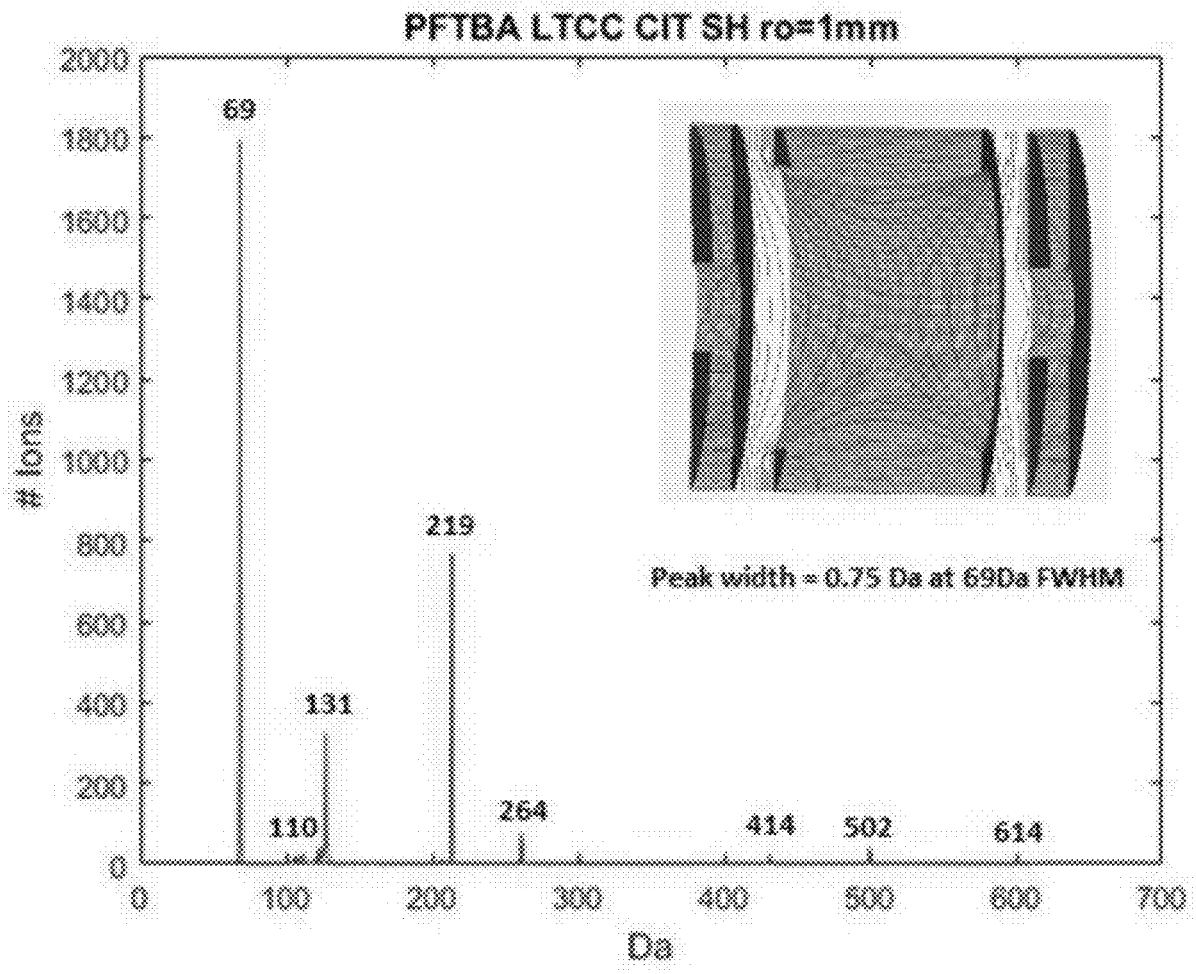
FIG. 6 is a mass spectrum of PFTBA generated using a low temperature co-fired ceramic (LTCC) CIT according to an embodiment of the subject invention, using an $r_o$ of 1 mm. The inset image shows a cross-sectional view of the CIT with electrostatic field lines.

FIG. 6 shows another mass spectrum of PFTBA generated using a low temperature co-fired ceramic (LTCC) CIT, using an $r_o$ of 1 mm. The inset image shows a cross-sectional view of the CIT with electrostatic field lines.

EXAMPLE 2

Figure 7A:
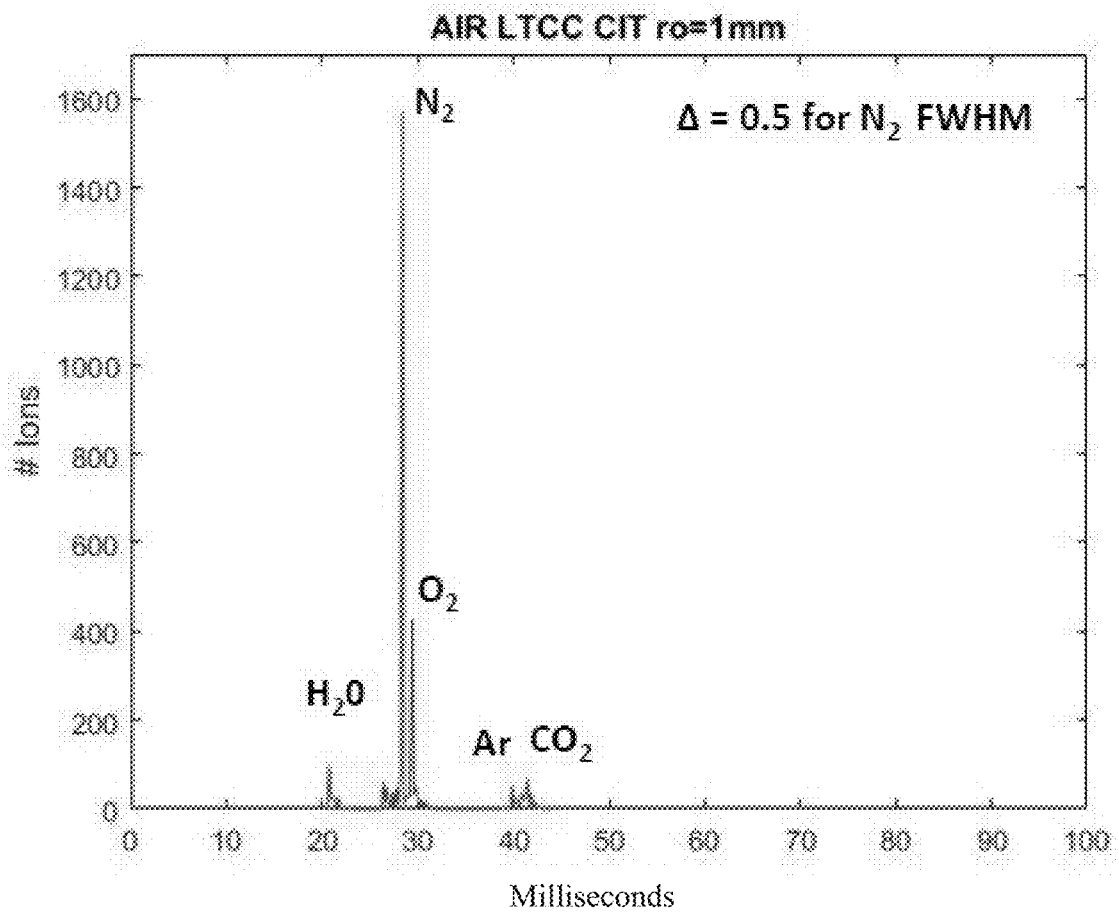
FIG. 7A shows a simulated mass spectrum of laboratory air generated using an LTCC CIT, using an $r_o$ of 1 mm.
Figure 7B:
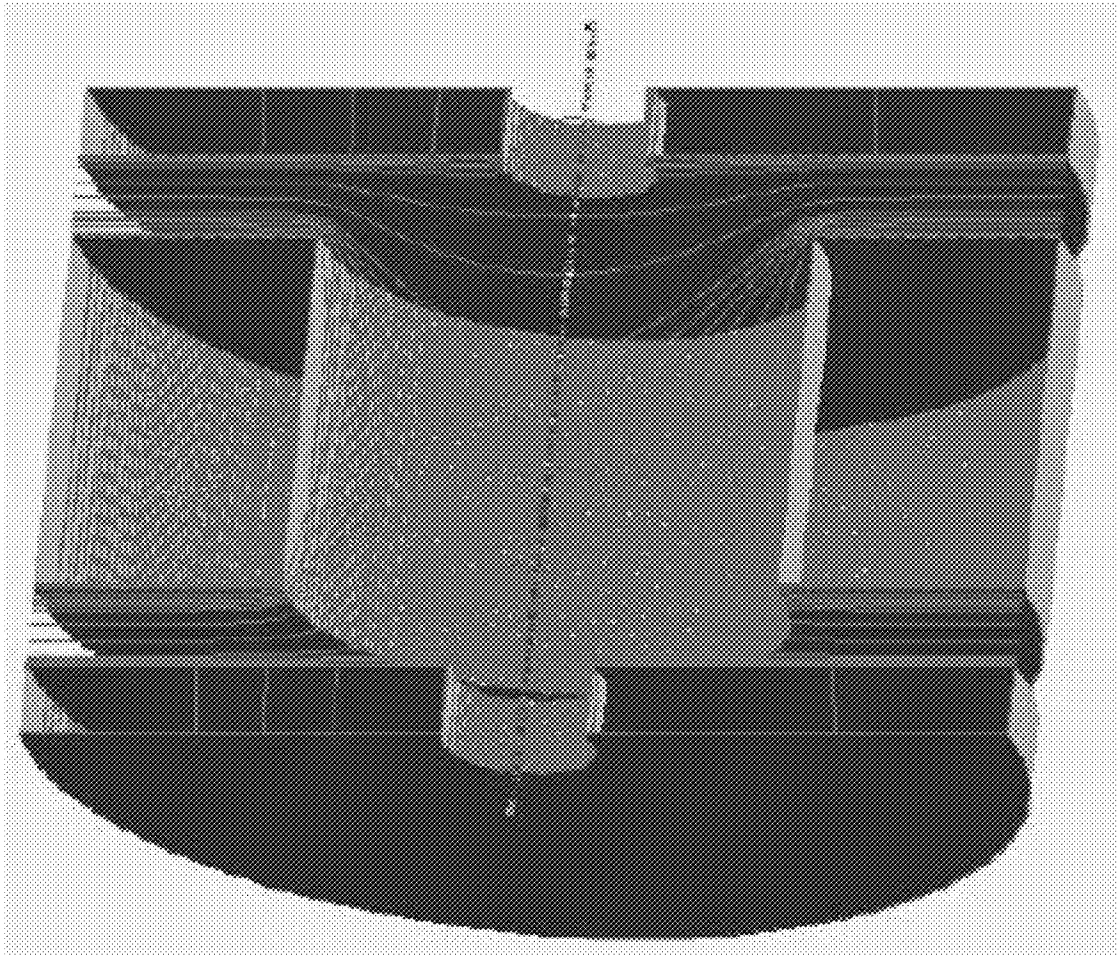
FIG. 7B shows a simulated cross-sectional view of the standard LTCC CIT used to generate the spectrum in FIG. 7A.

For comparison purposes, a mass spectrum of laboratory air was simulated, based on using an LTCC CIT, with an $r_o$ of 1 mm. FIG. 7A shows the simulated mass spectrum of laboratory air, and FIG. 7B shows a simulated cross-sectional view of the standard LTCC CIT used to generate the spectrum in FIG. 7A.

EXAMPLE 3

Figure 9A:
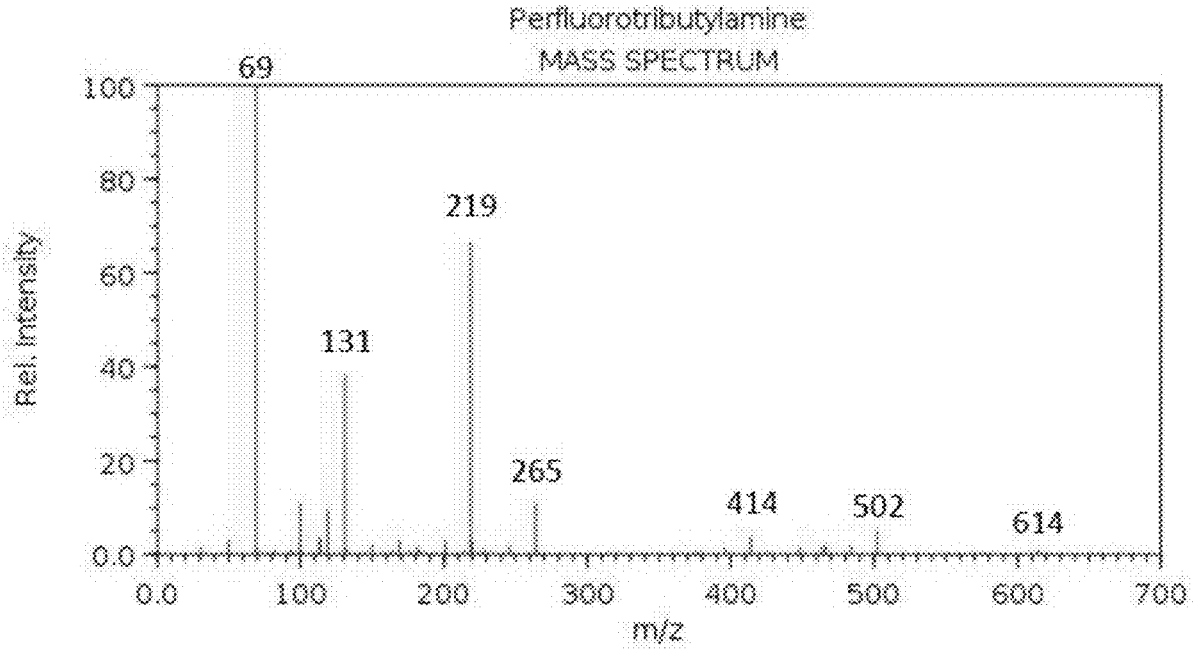
FIG. 9A shows a National Institute of Standards and Technology (NIST) standard mass spectrum of PFTBA (obtained from NIST Chemistry WebBook, http://webbook.nist.gov/chemistry).
Figure 9B:
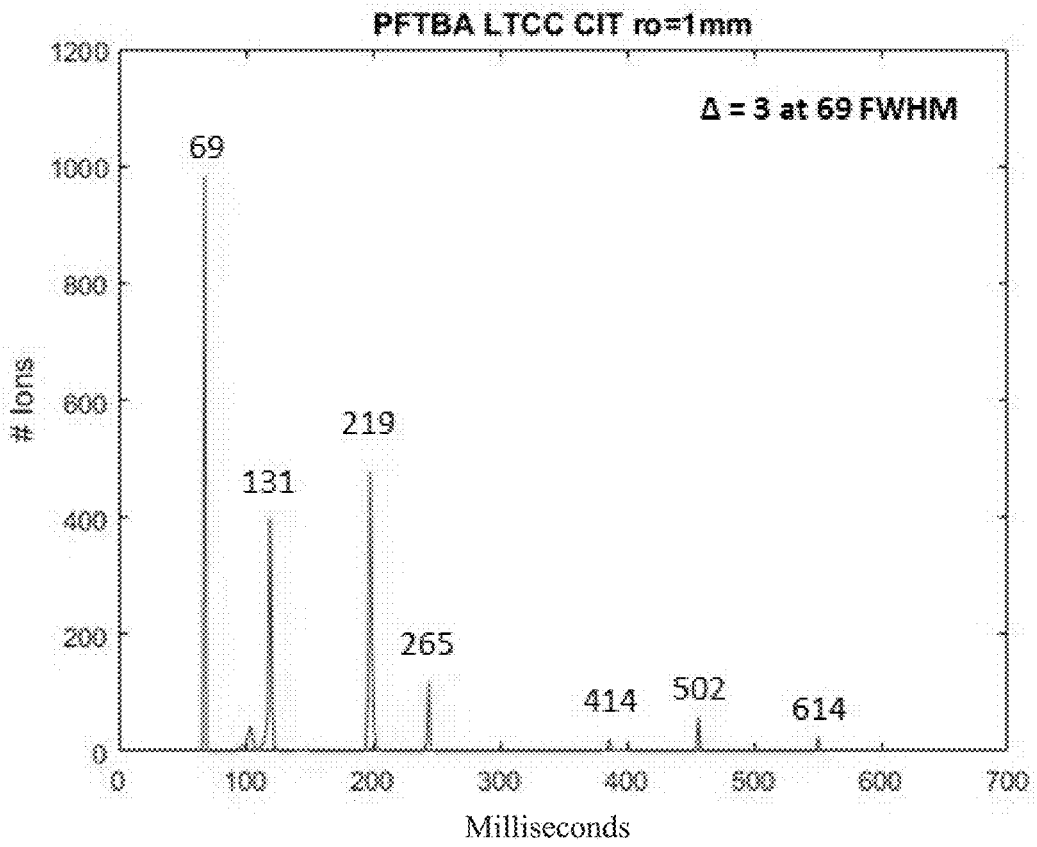
FIG. 9B shows a simulated mass spectrum of PFTBA generated using a notched LTCC CIT according to an embodiment of the subject invention. Comparing with the NIST standard in FIG. 9A shows excellent agreement.

A mass spectrum of PFTBA was generated using a computer simulation, based on a notched LTCC CIT according to an embodiment of the subject invention. FIG. 9B shows the simulated mass spectrum of PFTBA generated using the notched LTCC CIT, and FIG. 9A shows the NIST standard mass spectrum of PFTBA. Comparing the simulated mass spectrum with the NIST standard in FIG. 9A shows excellent agreement.

EXAMPLE 4

Figure 8A:
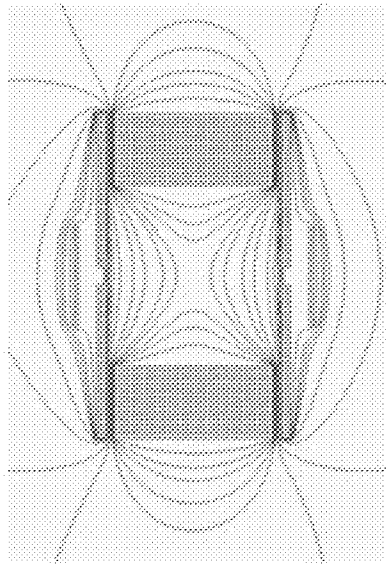
FIG. 8A shows a cross-sectional view of a standard CIT, showing the CIT geometry and electrostatic field lines.
Figure 8B:
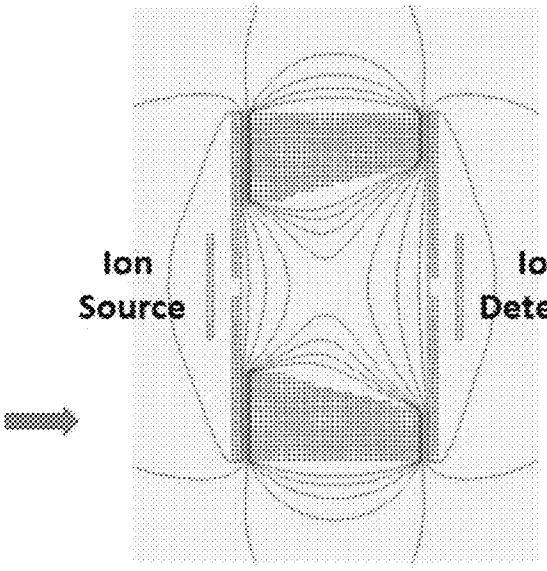
FIG. 8B shows a cross-sectional view of a notched CIT according to an embodiment of the subject invention, showing the CIT geometry and electrostatic field lines. The ion source and ion detector are also displayed.
Figure 8C:
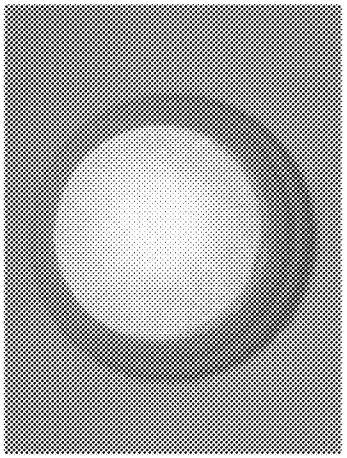
FIG. 8C shows an image of a notched ring electrode structure in an LTCC CIT according to an embodiment of the subject invention.
Figure 10A:
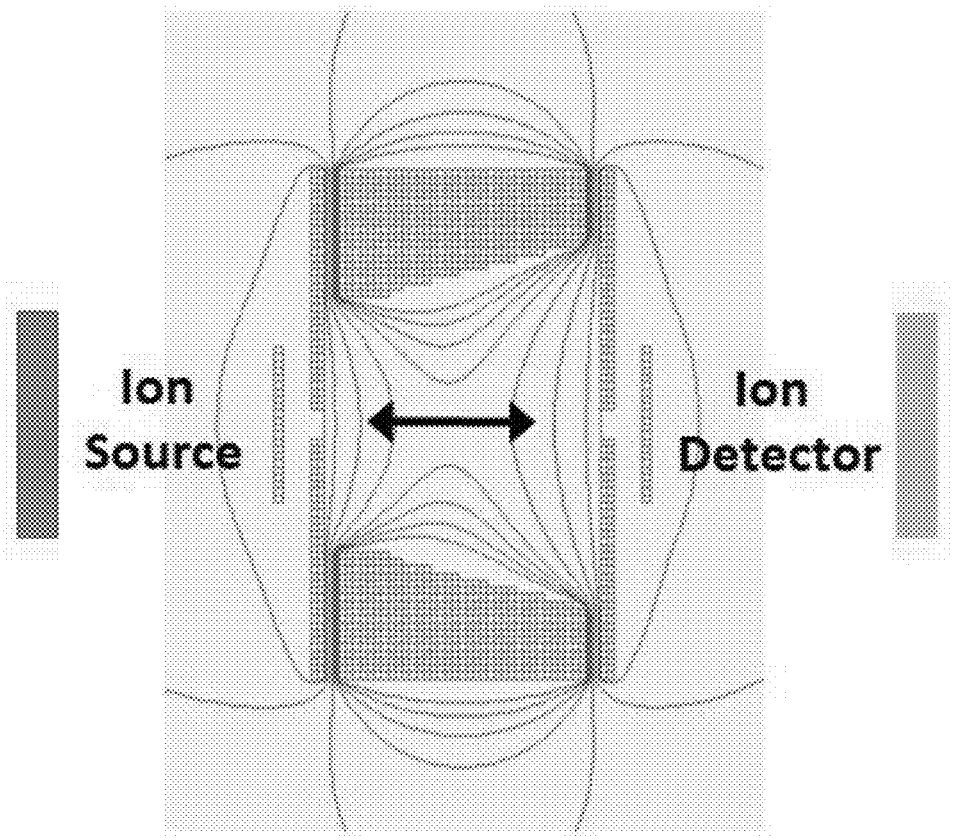
FIG. 10A shows a cross-sectional view of a CIT according to an embodiment of the subject invention, showing the CIT geometry and electrostatic field lines. The ion source and ion detector are also displayed and then exaggerated on the outer section of the image.
Figure 10B:
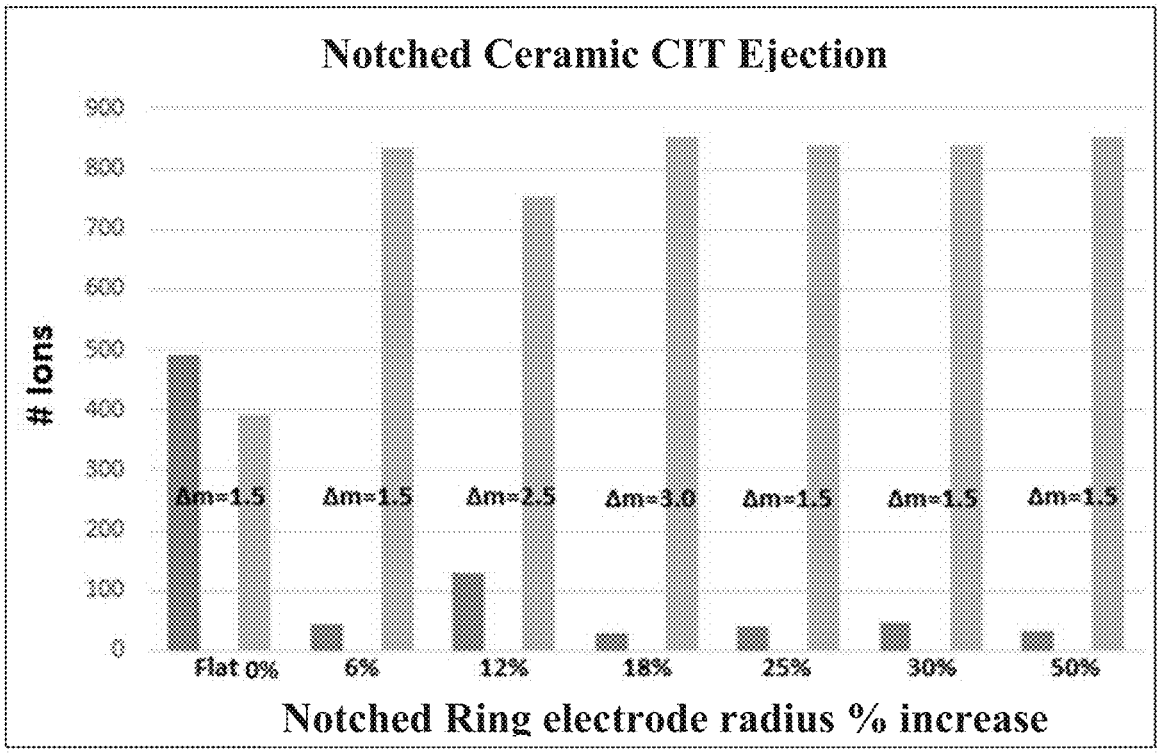
FIG. 10B shows results of a simulation for the CIT of FIG. 10A with changing notched ring electrode radius percentage increase. The left-hand bar for each listed percentage (0%, 6%, 12%, 18%, 25%, 30%, and 50%) represents the number of ions ejected from the CIT to the ion source side, and the right-hand bar for each listed percentage (0%, 6%, 12%, 18%, 25%, 30%, and 50%) represents the number of ions ejected from the CIT to the ion detector side. It can be seen that a notched design, compared to a flat design (i.e., CIT design), advantageously results in a much higher proportion of ions ejected to the ion detector side.

A computer simulation was run to show ion detection efficiency with varied notched ring electrode radius percentage increase. FIG. 10A shows a cross-sectional view of the CIT, and FIG. 10B shows the results of the simulation. Referring to FIG. 10B, the left-hand bar for each listed percentage (0%, 6%, 12%, 18%, 25%, 30%, and 50%) represents the number of ions ejected from the CIT to the ion source side, and the right-hand bar for each listed percentage (0%, 6%, 12%, 18%, 25%, 30%, and 50%) represents the number of ions ejected from the CIT to the ion detector side. It can be seen that a notched design, compared to a flat design (i.e., standard design as seen in FIGS. 1, 7B, and 8A), advantageously results in a much higher proportion of ions ejected to the ion detector side.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A cylindrical ion trap (CIT), comprising:
- a first end electrode at a first axial end of the CIT;
- a second end electrode at a second axial end of the CIT opposite to the first axial end; and
- a ring electrode disposed axially between the first end electrode and the second electrode and having an annular shape with an inner opening having an inner diameter,
- the inner diameter of the ring electrode increasing as the first end electrode is approached from an axial center of the CIT, such that the inner diameter of the ring electrode at the axial center is smaller than the inner diameter of the ring electrode at a position thereof closest to the first end electrode, and
- the inner diameter of the ring electrode increasing as the axial center is approached from the second electrode.

2. The CIT according to claim 1, the first end electrode comprising a first opening,
- the second end electrode comprising a second opening, and
- a center axis of the CIT passing through the first opening, the second opening, and the inner opening of the ring electrode.

3. The CIT according to claim 1, the inner diameter increasing in a stepped manner as the first end electrode is approached.

4. The CIT according to claim 1, the inner diameter increasing in a continuous manner as the first end electrode is approached.

5. The CIT according to claim 1, further comprising a body comprising a ceramic material.

6. The CIT according to claim 5, the ceramic material being a low temperature co-fired ceramic (LTCC) material.

7. The CIT according to claim 1, the inner diameter increasing as the first end electrode is approached in such a way that the CIT is configured to direct at least 75% of ions towards the first axial end when a voltage is applied to the CIT.

8. A system for molecular sample identification, comprising:
- the CIT according to claim 1;
- an ion source disposed outside the CIT and positioned facing the second end of the CIT; and
- an ion detector disposed outside the CIT and positioned facing the first end of the CIT.

9. A method for molecular sample identification, the method comprising:
- providing a sample to a cylindrical ion trap (CIT), the CIT comprising:
  - a first end electrode at a first axial end of the CIT;
  - a second end electrode at a second axial end of the CIT opposite to the first axial end; and
  - a ring electrode disposed axially between the first end electrode and the second electrode and having an annular shape with an inner opening having an inner diameter,
  - the inner diameter of the ring electrode increasing as the first end electrode is approached from an axial center of the CIT, such that the inner diameter of the ring electrode at the axial center is smaller than the inner diameter of the ring electrode at a position thereof closest to the first end electrode;
- applying a voltage to the CIT such that ions of the sample are axially ejected from the CIT; and
- detecting at least a portion of the ejected ions of the sample to generate a mass spectrum to identify the sample,
- the inner diameter of the ring electrode increasing as the axial center is approached from the second electrode.

10. The method according to claim 9, the first end electrode comprising a first opening,
- the second end electrode comprising a second opening, and
- a center axis of the CIT passing through the first opening, the second opening, and the inner opening of the ring electrode.

11. The method according to claim 10, the ions of the sample being axially ejected from the CIT such that at least 75% of the ions being ejected are ejected through the first opening of the first end electrode.

12. The method according to claim 10, the ions of the sample being axially ejected from the CIT such that at least 90% of the ions being ejected are ejected through the first opening of the first end electrode.

13. The method according to claim 9, the inner diameter increasing in a stepped manner as the first end electrode is approached.

14. The method according to claim 9, the inner diameter increasing in a continuous manner as the first end electrode is approached.

15. The method according to claim 9, the CIT further comprising a body comprising a ceramic material.

16. The method according to claim 15, the ceramic material being a low temperature co-fired ceramic (LTCC) material.

17. The method according to claim 9, the detecting of the at least a portion of the ejected ions comprising using an ion detector disposed outside the CIT and positioned facing the first end of the CIT, and the providing of the sample to the CIT comprising using an ion source disposed outside the CIT and positioned facing the second end of the CIT.

18. A system for molecular sample identification, comprising:

a cylindrical ion trap (CIT), comprising:

a first end electrode at a first axial end of the CIT;

a second end electrode at a second axial end of the CIT opposite to the first axial end; and a ring electrode disposed axially between the first end electrode and the second electrode and having an annular shape with an inner opening having an inner diameter, the inner diameter of the ring electrode increasing as the first end electrode is approached from an axial center of the CIT, such that the inner diameter of the ring electrode at the axial center is smaller than the inner diameter of the ring electrode at a position thereof closest to the first end electrode;

an ion source disposed outside the CIT and positioned facing the second end of the CIT; and an ion detector disposed outside the CIT and positioned facing the first end of the CIT, the first end electrode comprising a first opening, the second end electrode comprising a second opening, a center axis of the CIT passing through the first opening, the second opening, and the inner opening of the ring electrode, the inner diameter of the ring electrode increasing as the axial center is approached from the second electrode, the inner diameter increasing in a stepped manner as the first end electrode is approached, the CIT further comprising a body comprising a low temperature co-fired ceramic (LTCC) material, and the inner diameter increasing as the first end electrode is approached in such a way that the CIT is configured to direct at least 75% of ions towards the first axial end when a voltage is applied to the CIT.

* * * * *